US005195471A

United States Patent [19]

Hara

[11] Patent Number: 5,195,471

[45] Date of Patent: Mar. 23, 1993

[54] VALVE TIMING CONTROL SYSTEM OF INTERNAL COMBUSTION ENGINE

[75] Inventor: Seinosuke Hara, Kanagawa, Japan

[73] Assignee: Atsugi Unisia Corporation, Atsugi, Japan

[21] Appl. No.: 811,029

[22] Filed: Dec. 20, 1991

[30] Foreign Application Priority Data

Dec. 28, 1990 [JP] Japan ..... 2-408764
Jun. 27, 1991 [JP] Japan ..... 3-156753

[51] Int. Cl.[5] ..... F01L 1/34

[52] U.S. Cl. ..... 123/90.17; 123/90.31; 464/2

[58] Field of Search ..... 123/90.15, 90.17, 90.31; 464/2, 160

[56] References Cited

U.S. PATENT DOCUMENTS 4,498,431 2/1985 Nakamura et al. ..... 123/90.17
4,754,727 7/1988 Hampton ..... 123/90.15

FOREIGN PATENT DOCUMENTS 4007181 9/1991 Fed. Rep. of Germany .
309704 12/1988 Japan .
0134012 5/1989 Japan ..... 123/90.17

*Primary Examiner*—Tony M. Argenbright
*Assistant Examiner*—Weilun Lo
*Attorney, Agent, or Firm*—Bachman & LaPointe

[57] ABSTRACT

A valve timing control system of an internal combustion engine having a camshaft for operating intake or exhaust valves. The valve timing control system is comprised of a cylindrical sprocket driven through a timing chain by a crankshaft of the engine. An arm is fixed to one end of the camshaft and located inside the sprocket in a manner to extend generally diametrically. An annular piston is movably disposed coaxially with the camshaft and inside the sprocket to define an oil pressure chamber. The piston is moved axially by controlling the oil pressure to be supplied to the oil pressure chamber, in accordance with an engine operating condition. At least three sliders are supported to the piston to move with the piston. Each slider has an inclined face which is in slidable contact with a side face of the arm. This inclined surface is adapted to push the arm to rotate around the axis of the camshaft when each slider is moved axially upon the axial movement of the piston. The rotation of the arm causes the camshaft to make its relative rotational movement to the driven sprocket, thereby changing the opening and closing timings of the intake or/and exhaust valves.

17 Claims, 8 Drawing Sheets

VALVE TIMING CONTROL SYSTEM OF INTERNAL COMBUSTION ENGINE

BACKGROUND OF THE INVENTION

1. Field of the Invention

This invention relates to improvements in a valve timing control system for variably controlling the opening and closing timings of intake and/or exhaust valves of an internal combustion engine in accordance with an engine operating condition, more particularly to a device for making a relative rotational movement of a camshaft to a sprocket for driving the camshaft.

2. Description of the Prior Art

A variety of valve timing control systems of the above-mentioned type have been proposed and put into practical use. A typical example of one of them is disclosed in the U.S. Pat. No. 4,231,330 and arranged as set forth below. The valve timing control system is arranged to control a camshaft for operating intake and/or exhaust valves of an internal combustion engine. The camshaft is formed at its front end section with an external thread. A sleeve is disposed around the front end section of the camshaft in a manner that its internal thread is engaged with the external thread at the camshaft front end section. An outer cylindrical member is disposed and supported around the sleeve and the front end section of the camshaft and provided at its outer periphery with a driven sprocket to which a rotational force is transmitted through a timing chain from a crankshaft of the engine. The outer cylindrical member is formed at its inner periphery with an internal thread. Additionally, a cylindrical gear is threadingly disposed between the internal thread of the outer cylindrical member and the external thread of the camshaft front end section. At least one of the internal and external threads of the cylindrical gear is formed helical. This cylindrical gear is moved in the axial direction of the camshaft in accordance with an engine operating condition, under the pressure of a hydraulic circuit and the biasing force of a spring, so that the camshaft makes a relative rotating movement to the driven sprocket.

However, in the above-discussed conventional valve timing control system, a relative rotating movement is made between the driven sprocket and the camshaft by using the helical gear formed at least one of the inner or outer peripheral surfaces of the cylindrical gear. This helical gear requires a high precision machining to ensure a good engagement with the internal thread of the driven sprocket or the external thread of the camshaft. Thus, production or machining operation of the helical gear becomes troublesome and difficult, thereby lowering the operational efficiency in a production process while raising a production cost for the valve timing control system.

SUMMARY OF THE INVENTION

An object of the present invention is to provide an improved valve timing control system of an internal combustion engine, which can overcome the drawbacks encountered in conventional valve timing control systems.

Another object of the present invention is to provide an improved valve timing control system of an internal combustion engine, which is high in operational efficiency in production and low in production cost.

A further object of the present invention is to provide an improved valve timing control system of an internal combustion engine, in which a relative rotational phase of a camshaft to a driven sprocket can be changed in accordance with an engine operating condition without using a helical gear which is difficult to be manufactured.

A valve timing control system according to the present invention is of an internal combustion engine and is comprised of a generally cylindrical rotatable member coaxially and movably connected to one end of a camshaft. The rotatable member is drivably connected to a crankshaft of the engine. An arm is fixed to the one end of the camshaft and projecting radially outwardly. A generally annular piston is located coaxial with the camshaft and movably disposed inside the cylindrical rotatable member. The piston is movable in an axial direction of the camshaft. At least three sliding members are supported on the piston and slidably movable inside the rotatable member. Each sliding member has an inclined face which is inclined relative to a plane parallel with the axis of the camshaft so as to push the arm in a direction to rotate around the axis of the camshaft. The piston is driven in the axial direction of the camshaft in accordance with an engine operating condition, by a contollably driving device.

Accordingly, when the piston is moved in the axial direction of the camshaft in accordance with the engine operating condition, the sliding members are also moved with it so that the inclined faces thereof push the arm to make its rotational movement around the axis of the camshaft. Accordingly, the camshaft makes its relative rotational movement to the rotatable member driven by the crankshaft, thereby changing the rotational phase of the camshaft. This changes the opening and closing timings of intake and/or exhaust valves of the engine. Additionally, since three of more arms are used, the piston is prevented from receiving local or eccentric load due to unbalanced sliding frictional resistance during sliding movement of the sliding members to the arm, thus ensuring a smooth axial movement of the piston.

BRIEF DESCRIPTION OF THE DRAWINGS

In the drawings, like reference numerals designate like elements and parts throughout all the figures, in which.

DETAILED DESCRIPTION OF THE INVENTION

Figure 1:
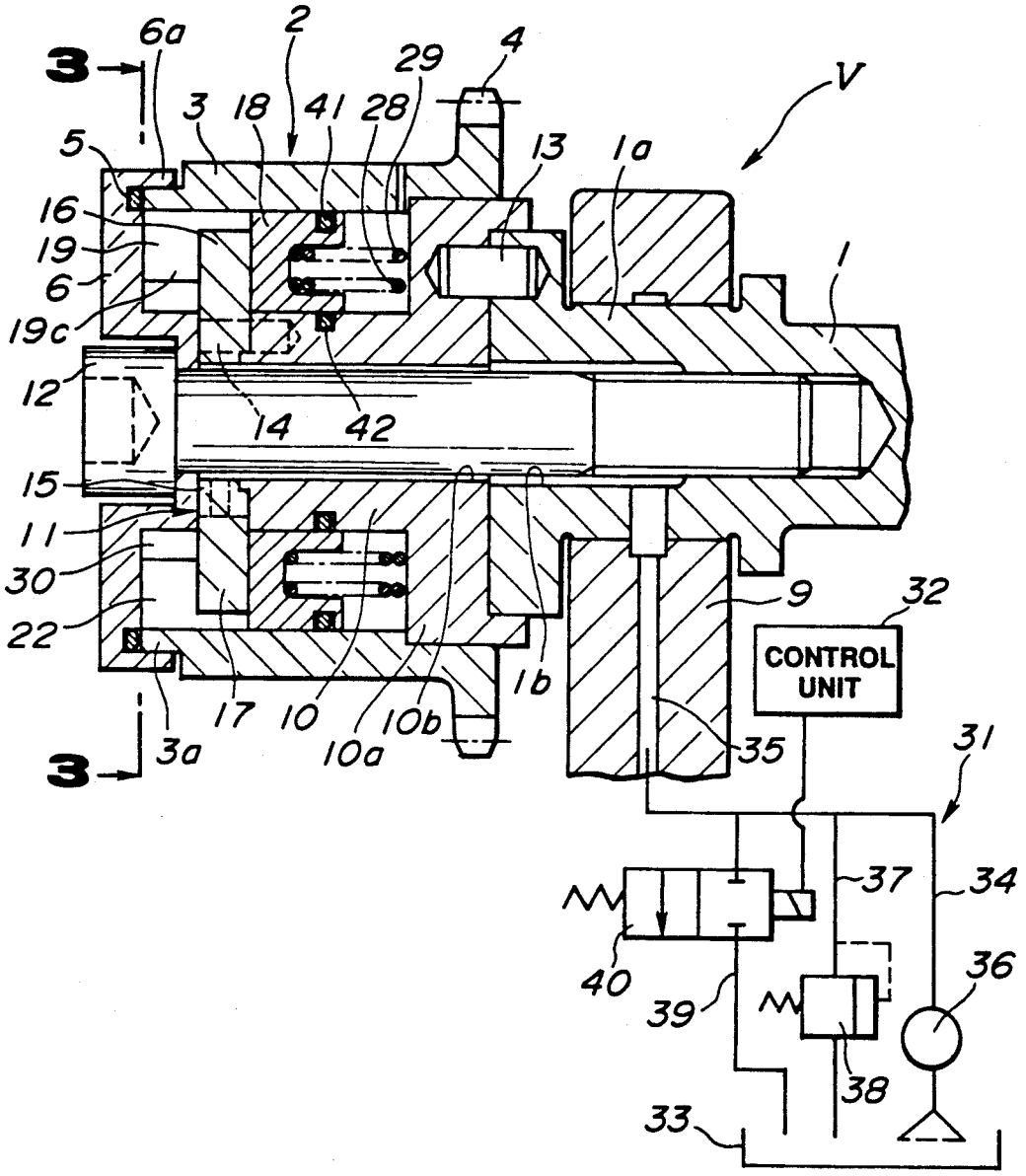
FIG. 1 is a vertical sectional view of a first embodiment of a valve timing control system in accordance with the present invention, showing an operational mode of the system.

Referring now to FIGS. 1 to 5, more specifically to FIG. 1, a first embodiment of a valve timing control system according to the present invention is illustrated by the reference character V. The valve timing control system V in this embodiment is arranged to control the operation of a camshaft 1 for intake valves of a gasoline-fueled double overhead camshaft automotive internal combustion engine (not shown) having four or more engine cylinders, mounted on an automotive vehicle. The camshaft 1 has a plurality of cam lobes (not shown) for operating intake valves (not shown) of the engine.

The valve timing control system V is comprised of a driven sprocket 2 which is disposed at one (front) end section 1*a* of the camshaft 1 and driven through a timing chain (not shown) by a driving sprocket (not shown) of a crankshaft (not shown) of the engine. The driven sprocket 2 includes a generally cylindrical sprocket main body 3 which is located coaxial with the camshaft 1. An annular gear section 4 is integrally formed at the outer periphery of the sprocket main body 3 at the rear end section, and located coaxial with the camshaft 1 to be rotated through the timing chain by the driving sprocket.

A front cover 6 is disposed to close the front end opening of the sprocket main body 3. More specifically, the sprocket main body 3 is formed slender at its front end section by forming a coaxial annular cutout (not identified) reaching the front extreme end of the sprocket main body 3, thereby forming a small-thickness front end portion 3*a*. The front end portion 3*a* is rotatably supported to the inner peripheral surface of an outer peripheral flange 6*a* of the front cover 6. The extreme front end of the small-thickness portion 3*a* of the sprocket main body 3 is in slidable contact with an annular sealing member 5 fixedly carried by the front cover 6 thereby to maintain a fluid tight seal between the sprocket main body 3 and the front cover 6. The sprocket main body 3 is integrally formed at its inner peripheral surface with generally radially inwardly protruding projections 7, 8 which are located opposite to each other with respect to the axis of the sprocket main body 3 as best shown in FIG. 3 and at front side predetermined positions of the sprocket main body 3.

The camshaft 1 is rotatably supported at the front end section 1*a* by a camshaft bearing 9. A sleeve 10, an arm 11 and the front cover 6 are fastened together to the front end section of the camshaft 1 by a bolt 12 which screwed through the extreme front end face into the front end section 1*a* of the camshaft 1 and positioned coaxial with the camshaft 1. As shown, the bolt 12 pierces the central part of each of the sleeve 10, arm 11 and front cover 6. The sleeve 10 is fixed in position relative to the extreme front end of the camshaft 1 by means of a knock-pin 14, and integrally formed with a radially outwardly extending annular flange section 10*a* which has a cylindrical outer peripheral surface on which the rear end section of the sprocket main body 3 is supported rotatably relative to the sleeve 10.

Figure 3:
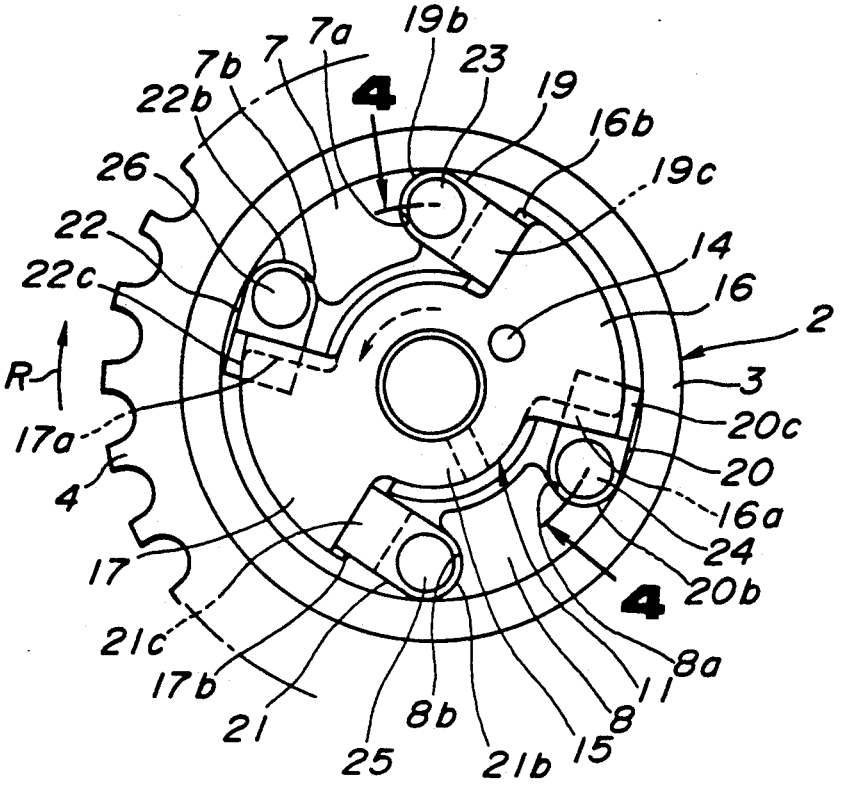
FIG. 3 is a cross-sectional view taken in the direction of arrows substantially along the line 3—3 of FIG. 1.

As shown in FIG. 3, the arm 11 is located generally on a vertical plane on which the projections 7, 8 lie. The arm 11 includes a generally annular base section 15 which is fixed in position relative the extreme front end of the sleeve 10 by means of a knock-pin 14. A pair of generally holding-fan shaped extending sections 16, 17 are formed integral with the annular base section 15 and radially outwardly extend. The extending sections 16, 17 are located opposite to each other with respect to the axis of the bolt 12. More specifically, the extending section 16 has two side contact faces 16*a*, 16*b* which are located opposite to each other in the peripheral direction of the arm 11 and extend generally radially. Similarly, the extending section 17 has two side contact faces 17*a*, 17*b* which are located opposite to each other in the peripheral direction of the arm 11 and extend generally radially.

Figure 4:
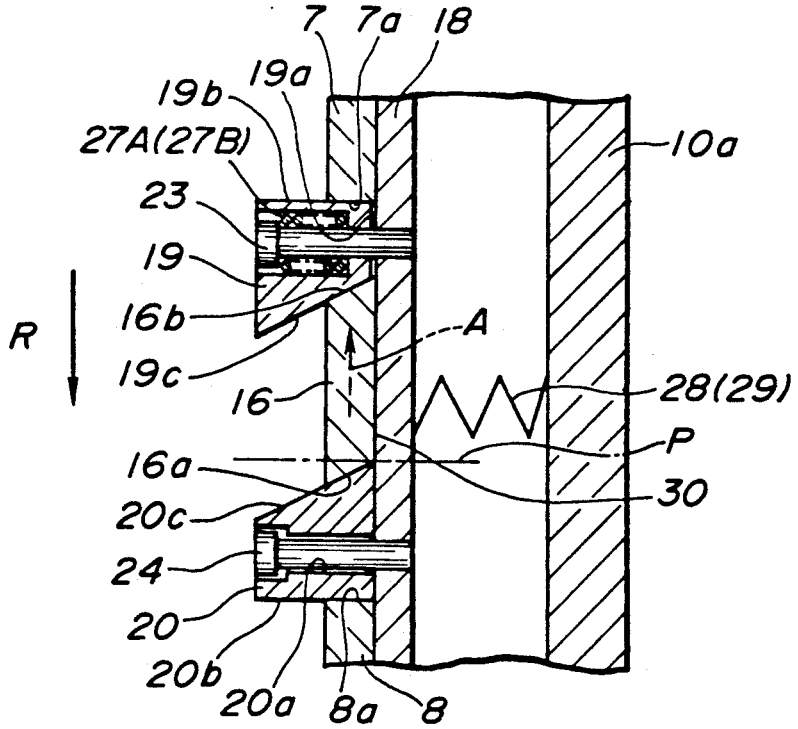
FIG. 4 is a sectional view taken in the direction substantially along the line 4—4 of FIG. 3, showing an operational mode of the sliding members.
Figure 5:
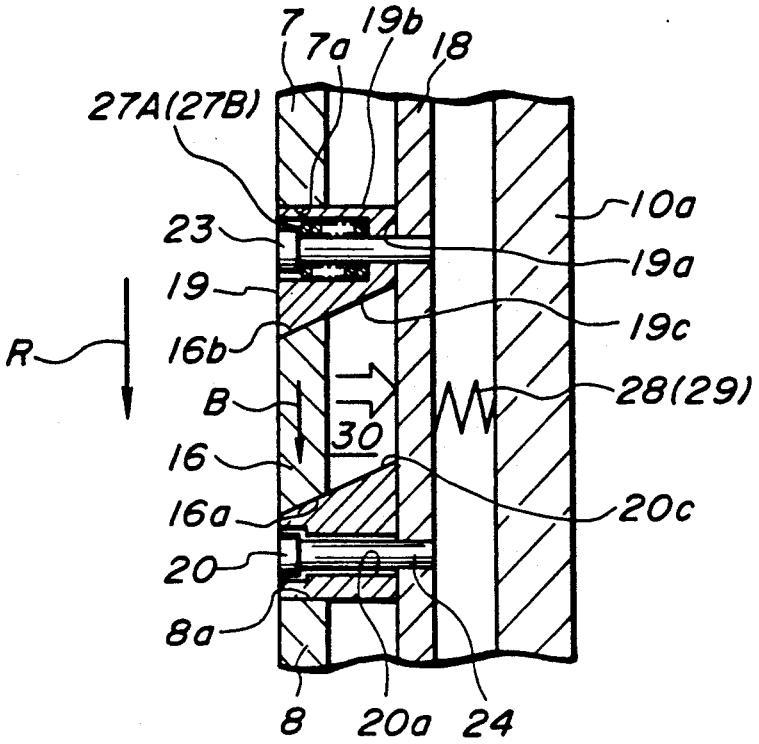
FIG. 5 is a sectional view similar to FIG. 4 but showing another operational mode of the sliding members.

Additionally, as illustrated in FIGS. 3 to 5, each of the side contact faces 16*a*, 17*a* of the extending sections 16, 17 inclines inwardly relative to a radially extending plane P vertical to the plane on which the arm 17 lies, in the direction toward the camshaft 1. Similarly, each of the side contact faces 16*b*, 17*b* of the extending sections 16, 17 inclines outwardly relative to the plane P in the direction of the camshaft 1. The side contact faces 16*a*, 17*a* are respectively located forward of the side contact faces 16*b*, 17*b* in a rotational direction (indicated by an arrow R) of the driven sprocket 2. As a result, the cross-section of each extending section 16, 17 is generally rhombic as taken along the line 4—4 of FIG. 3.

An annular piston 18 is interposed between the sprocket main body 3 and the sleeve 10 and located between the flange section 10*a* of the sleeve 10 and the arm 11 in a manner to be slidably movable in the axial direction of the camshaft 1. Four sliders 19, 20, 21, 22 are provided to cause the arm 11 to rotatably move, and located generally equidistant in the peripheral direction of the piston 18. As seen from FIGS. 3 to 5, each slider 19, 20, 21, 22 is generally rectangular in cross-section as taken along the line 4—4 of FIG. 3 and located between each side contact face 7*a*, 7*b*, 8*a*, 8*b* of each projection 7, 8 and each side contact face 16*a*, 16*b*, 17*a*, 17*b* of each extending section 16, 17 of the arm 11. Each slider 19, 20, 21, 22 is rotatably supported to the piston 18 at the front end surface through a pin 23, 24, 25, 26 which is disposed in a pin hole 19*a*, 20*a*, 21*a*, 22*a* and fixed to the piston 18. Each pin hole 19*a*, 20*a*, 21*a*, 22*a* passes through the slider 19, 20, 21, 22 and has small and large diameter sections (not identified).

Each slider 19, 20, 21, 22 has a first end face 19*b*, 20*b*, 21*b*, 22*b* which is formed round and in slidable contact with the rounded side contact face 7*a*, 7*b*, 8*a*, 8*b* of the projection 7, 8. A second end face 19*c*, 20*c*, 21*c*, 22*c* of each slider 19, 20, 21, 22 faces and slidable contacts with the side contact face 16*a*, 16*b*, 17*a*, 17*b* of the extending section 16, 17 of the arm 11. The second end face 19*c*, 20*c*, 21*c*, 22*c* inclines relative to the above-mentioned plane P with the same inclination angle as that of the corresponding and contacting side contact face 16*a*, 16*b*, 17*a*, 17*b* of the extending section 16, 17. In other words, each second end face 19c, 20c, 21c, 22c is parallel with each side contact face 16a, 16b, 17a, 17b to maintain a tight slidable surface contact therebetween. Additionally, each of the two sliders 19, 21 having the second end face 19c, 21c inwardly inclining in the direction toward the camshaft 1 is provided with a coil spring 27A (27B) located in the large diameter section of the pin hole 19a, 21a in a manner to fit between the bottom of the pin hole large diameter section and the head of the pin 23, 25. Accordingly, each slider 19, 21 is always biased toward the piston 18 under the action of the coil spring 27A (27B) so that the second end face 19c, 21c of the slider 19, 21 and the side contact face 16b, 17b of the extending section 16, 17 are always maintained in a tight slidably contact state.

Figure 2:
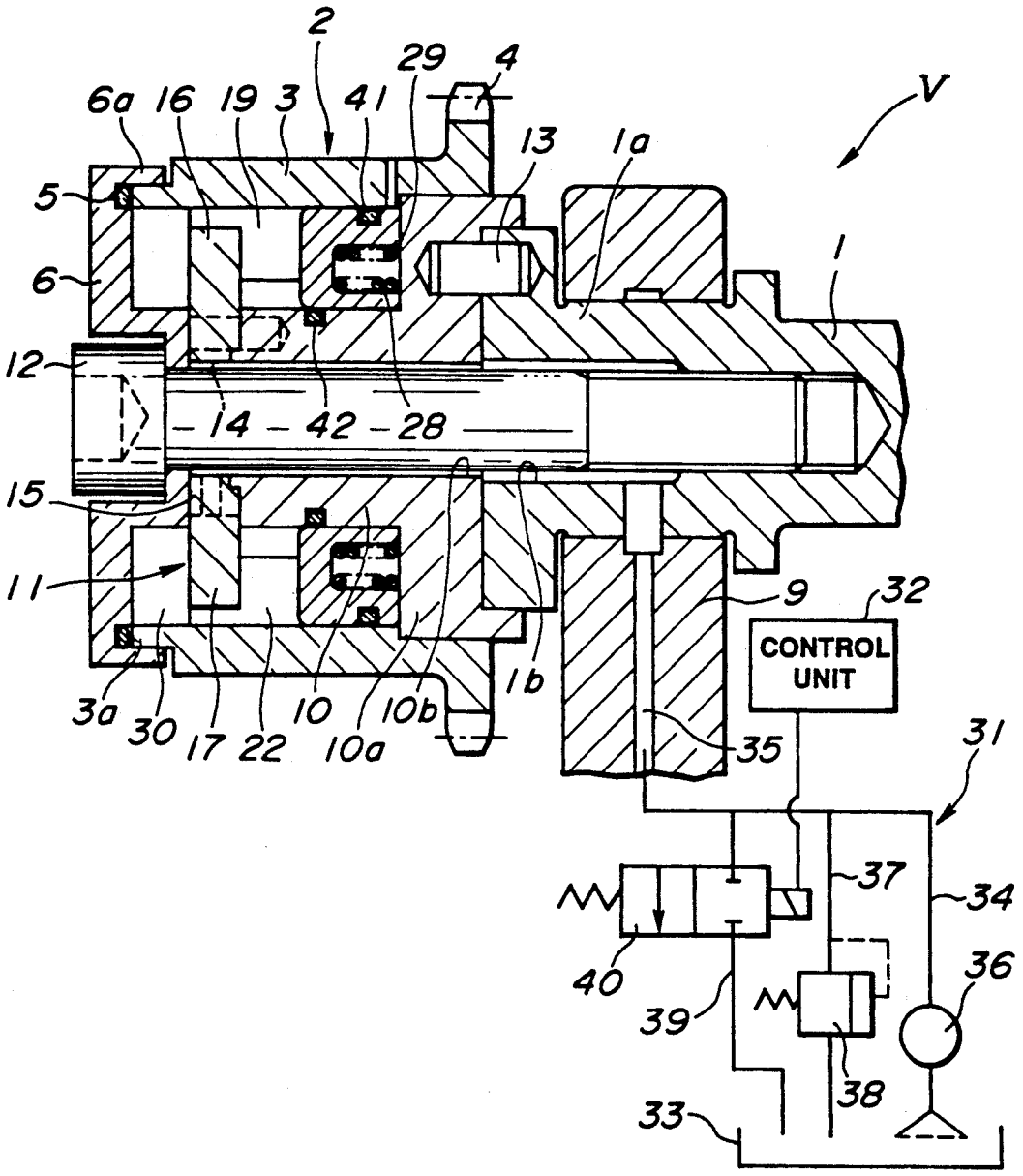
FIG. 2 is a vertical sectional view similar to FIG. 1 but showing another operational mode of the valve timing control system of FIG. 1.

As shown in FIGS. 1 and 2, inner and outer compression springs 28, 29 are disposed between the rear face of the piston 18 and the front side surface of the flange section 10a of the sleeve 10 thereby to bias the piston 18 toward the arm 16. It is sufficient that the compression springs 28, 29 have a biasing force for overcoming a sliding resistance of the piston 18 and for displacing hydraulic oil in front of the piston 18, so that the compression springs 28, 29 are unnecessary to have an excessive high biasing force. A hydraulic oil pressure chamber 30 is defined between the front cover 6 and the front end face of the piston 18. The pressure chamber 30 is supplied with hydraulic oil or pressure to push the piston 18 toward the camshaft 1 against the biasing force of the compression springs 28, 29. The pressure chamber 30 is connected through an oil passage 35 with a main gallery 34 of a hydraulic oil pressure supply system 31. The oil passage 35 includes a first part (indicated by broken lines in FIGS. 1, 2 and 3) formed in the base section 15 of the arm 11 to extend radially and reach the pressure chamber 30. A second part of the oil passage 35 is communicated with the first part and formed between the shaft section of the bolt 12 and the surface of the bolt holes 10b, 1b of the sleeve 10 and the camshaft 1. A third part of the oil passage 35 is formed vertically in the camshaft bearing 9 and communicating with the above-mentioned second part.

The piston 18 is formed at its outer peripheral surface with an annular groove (not identified) in which an annular seal member 41 is fitted to maintain an oil tight seal between the piston 18 and the main body 3 of the driven sprocket 2. The sleeve 10 is formed at its outer peripheral surface with an annular groove (not idenfitied) in which an annular seal member 42 is fitted to maintain an oil tight seal between the piston 18 and the sleeve 10.

The main gallery 34 is connected with an oil pump 36 for pressuring lubricating or hydraulic oil within an oil pan 33. A relief passage 37 is connected to the main gallery 34 and provided with a pressure regulator valve 38 for regulating oil pressure to be supplied to the pressure chamber 30 through the main gallery 34. Additionally, a return passage 39 is connected to the main gallery 34 and provided with an electromagnetic valve 40 for controlling the oil pressure to be supplied to the pressure chamber 30 through the main gallery 34. The operation of the electromagnetic valve 40 is controlled by a control unit 32 including a microcomputer. The control unit 32 is arranged to detect an engine operating condition at the present time by inputting signals representative of an engine speed, an air flow amount in the intake system (not shown) of the engine and the like, and to output signals to open the electromagnetic valve 40 under a low engine speed and low engine load operating condition or under a high engine speed and high engine load operating condition and to close the electromagnetic valve 40 under a low engine speed and high engine load operating condition. The signals representative of the engine speed, air flow amount and the like are output respectively from an engine speed sensor for sensing engine speed of the engine, an air flow sensor for sensing the air flow amount in the engine intake system, and the like. It will be understood that the air flow amount is representative of the engine load.

The manner of operation of the first embodiment valve timing control system V will be discussed hereinafter.

Under the low engine speed and low engine load operating condition, the electromagnetic valve 40 is opened, and therefore lubricating oil supplied under pressure from the oil pump 36 to the main gallery 34 is returned through the return passage 39 to the oil pan 33 so as not to be supplied to the pressure chamber 30. Accordingly, the piston 18 is pushed forward under the bias of the compression springs 28, 29 to take a position shown in FIG. 1, in which each slider 19, 20, 21, 22 moves forward upon being slidingly guided along each side contact face 7a, 8a, 8b, 7b of the projection 7, 8. Accordingly, the second end faces 20c, 22c of the sliders 20, 22 push the corresponding or contacting side contact faces 16a, 17a of the arm extending sections 16, 17 in a direction indicated by an arrow A in FIG. 4, so that the arm 11 is rotatingly moved in the reverse direction to the rotational direction R of the driven sprocket 2. Consequently, the camshaft 1 makes a relative rotation in the reverse direction to the rotational direction R of the driven sprocket 2, i.e., in the direction indicated by the arrow A in FIG. 3. As a result, the rotational phase of the camshaft 1 is changed to a retarded side thereby to relatively retard the opening and closing timings of the intake valves of the engine. Such a retarding control of the opening timing of the intake valves makes possible to minimize a valve-overlap in which both the intake and exhaust valves are opened. This reduces remaining gas in each engine cylinder thereby to stabilize combustion in the cylinder thus improving the brake thermal efficiency of the engine, improving fuel economy. Additionally, such a retarding control of the closing timing of the intake valves makes it possible to lower the pumping loss of the engine.

Under the high engine speed and high engine load operating condition, an operation similar to that during the low engine speed and low load operating condition is carried out, in which the piston 18 is forced forward under the bias of the compression springs 28, 29 so that the arm 11 is rotatingly moved in the reverse direction to the rotational direction R of the driven sprocket 2. As a result, the rotational phase of the camshaft 1 is changed to the retarded side thereby retarding the closing timing of the intake valves. This improves the charging efficiency for intake air thus increasing an engine power output at a high engine speed.

Under the low engine speed and high engine load operating condition, the electromagnetic valve 40 is closed. and therefore the lubricating oil from the oil pump 36 is supplied under pressure to the hydraulic oil pressure chamber 30 through the main gallery 34 and the oil passage 35, generating an oil pressure. The oil pressure is applied to the front end face of the piston 18, and therefore the piston 18 with the sliders 19, 20, 21, 22 is moved backward against the bias of the compression springs 28, 29 to take a position shown in FIGS. 2 and 5. Accordingly, the second end faces 19*c*, 21*c* of the sliders 19, 21 pushes the corresponding or contacting side contact faces 16*b*, 17*b* of the arm extending sections 16, 17 in a direction of an arrow B in FIG. 5, upon sliding movement of each side contact face 16*b*, 17*b* of the arm extending sections 16, 17 along the inclined second end face 19*c*, 21*c* of the slider 19, 21. As shown in FIG. 5, at the left-most position of the piston 18, each slider 19, 20, 21, 22 reaches a position at which the front surface of the arm 11 is brought into flush with the front face of each slider 19, 20, 21, 22. Thus, the arm 11 is rotatingly moved in the same direction as the rotational direction R of the driven sprocket 2. Hence, the camshaft 1 makes its relative rotation to the driven sprocket 2 in the direction B same as the rotational direction R of the driven sprocket 2, thereby changing the rotational phase of the camshaft to an advanced side. As a result, the closing timing of the intake valves is advanced thereby to improve the charging efficiency for intake air while improving an output torque at a low engine speed.

It will be understood that, in the first embodiment, the second end faces 19*c*, 21*c* of the sliders 19, 21 are respectively always brought into tight contact with the facing side contact faces 16*b*, 17*b* of the arm extending sections 16, 17 under the action of the coil springs 27, 28, so that no clearance lies between the arm 11 and the sliders 19, 21 thereby preventing noise generation due to striking of each slider 19, 21 against the arm 11 which striking being caused by a torque fluctuation of the engine.

As appreciated from the above, according to the first embodiment, a relative rotational phase between the camshaft 1 and the driven sprocket can be securely changed with a high response in accordance will an engine operating condition, without using a conventional cylindrical gear, thereby improving a production operation while reducing a production cost of a valve timing control system of an engine.

Additionally, the four sliders 19, 20, 21, 22 are provided in which a pair of the sliders 19, 21; 20, 22 are located generally symmetrical with respect to the axis of the camshaft 1, and therefore the piston 18 is prevented from receiving an offset load due to an unbalanced sliding frictional resistance during sliding movement between the second end faces 19*c*, 20*c*, 21*c*, 22*c* of the sliders 19, 20, 21, 22 and the side contact faces 16*a*, 16*b*, 17*a*, 17*b* of the arm 11. Thus, a uniform force is applied to the whole piston 18 under the action of the symmetrically located four sliders 19, 20, 21, 22, so that the piston 18 can be effectively prevented from its inclination relative to the axis thereof thereby to ensure a smooth reciprocal movement of the piston 18. In other words, assuming that there are only one or two sliders, the piston 18 will incline relative to the driven sprocket 2 and the sleeve 10 owing to an unbalanced sliding frictional resistance along the peripheral direction of the piston 18, thereby providing the possibility of the outer peripheral portion of the piston 18 being stuck to the inner peripheral surface of the sprocket main body 3 and the outer peripheral surface of the sleeve 10.

Figure 6:
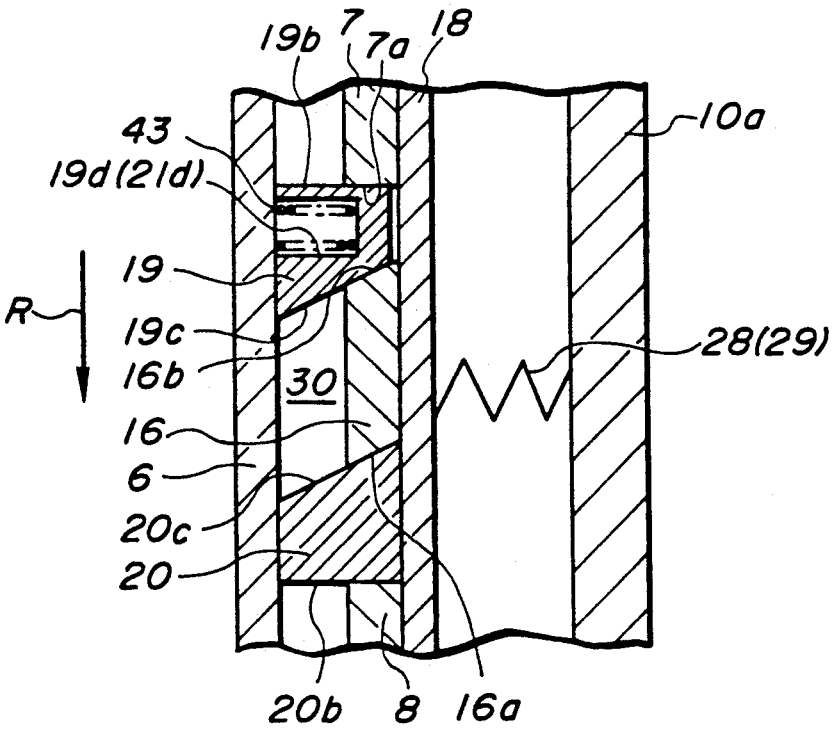
FIG. 6 is a sectional view similar to FIGS. 4 and 5, but showing an essential part of a second embodiment of the valve timing control system in accordance with the present invention, illustrating an operational mode of sliding members.
Figure 7:
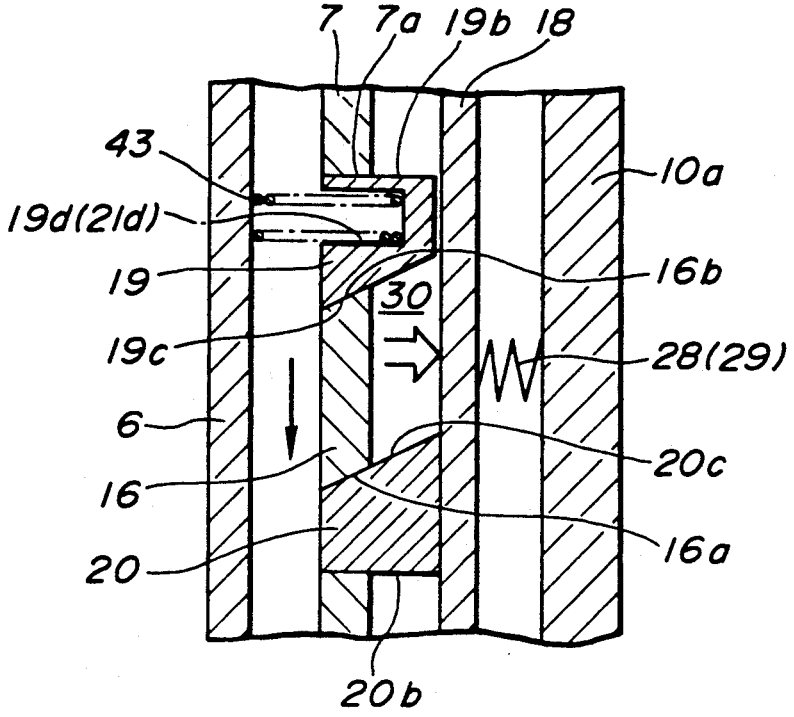
FIG. 7 is a sectional view similar to FIG. 6 but illustrating another operational mode of the sliding members.

FIGS. 6 and 7 illustrate an essential part of a second embodiment of the valve timing control system V of the present invention, similar to the first embodiment with the exception that each slider 19, 20, 21, 22 is fittingly interposed between each extending section 16, 17 and each projection 7, 8 of the driven sprocket 2 without using a pin (23, 24, 25, 26). In this embodiment, the sliders 19, 21 are always biased in such a direction that their second end faces 19*c*, 21*c* are always brought into slidable contact with the side contact faces 16*b*, 17*b* of the arm extending sections 16, 17, under the action of a compression spring 43 disposed between the bottom surface of a spring receiving hole 19*d*, 21*d* of the sliders 19, 21 and the inner end surface of the front cover 6.

It will be appreciated that it is matter of course that this embodiment provides the similar effect to the first embodiment. Additionally, since the pins 23, 24, 25, 26 in the first embodiment have been omitted, the valve timing control system of this embodiment can be simplified in construction and improved in manufacturing operational efficiency, lowering a production cost.

FIGS. 8 to 12 illustrate a third embodiment of the valve timing control system of the present invention, similar to the first embodiment of FIGS. 1 to 5 except for a mechanism for reciprocally driving the piston 18. In this embodiment, the sleeve 10 is shortened as compared with that in the first embodiment. The front cover 6 is formed with a relatively long inner cylindrical section 6*b* which is formed along the inner periphery thereof and coaxial with the camshaft 1 and the bolt 12. The inner cylindrical section 6*b* extends in the axial direction of and toward the camshaft 1. The inner cylindrical section 6*b* has a radially inwardly extending annular portion 6*c* which is fastened together with the arm 11 and the sleeve 10 onto the front end section of the camshaft 1 by means of the bolt 12.

Figure 10:
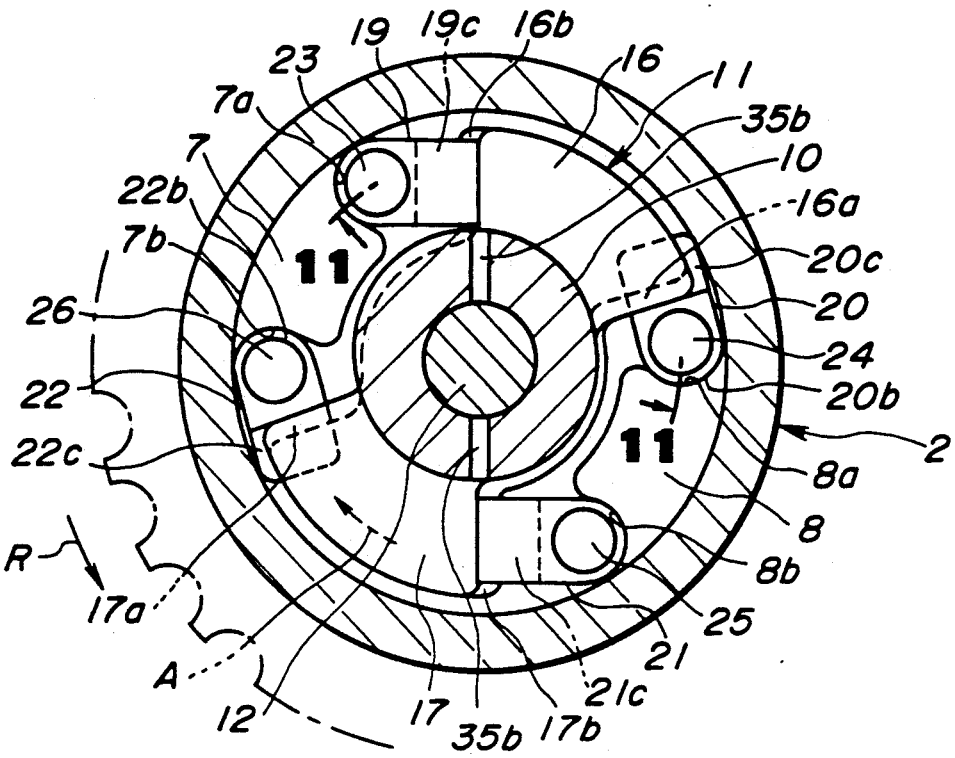
FIG. 10 is a sectional view taken in the direction of arrows substantially along the line 10—10 of FIG. 8.
Figure 11:
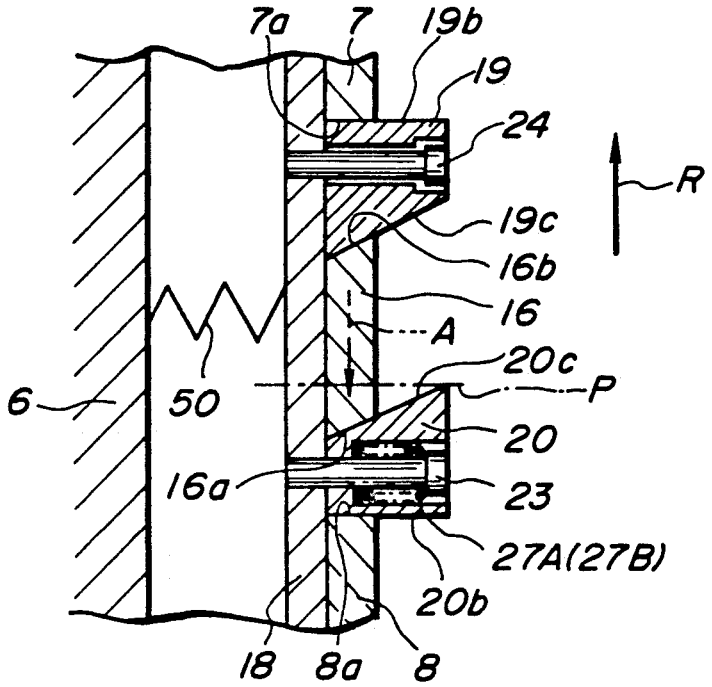
FIG. 11 is a sectional view taken in the direction of arrows substantially along the line 11—11 of FIG. 10, showing an operational mode of sliding members.

The piston 18 is disposed on the side of the front cover 6 in contrast with that in the first and second embodiments. More specifically, the piston 18 is slidably movably interposed between the front cover 6 and the arm 16. In this embodiment, as shown in FIG. 10, four sliders 19, 20, 21, 22 are provided to cause the arm 11 to rotatably move, and located at generally equal intervals in the peripheral direction of the piston 18. Each slider 19, 20, 21, 22 is generally rectangular in cross-section as taken along the line 11—11 of FIG. 10 and located between each side contact face 7*a*, 7*b*, 8*a*, 8*b* of each projection 7, 8 and each side contact face 16*a*, 16*b*, 17*a*, 17*b* of each extending section 16, 17 of the arm 11. Each slider 19, 20, 21, 22 is rotatably supported to the piston 18 at the rear end surface through a pin 23, 24, 25, 26 which is disposed in a pin hole 19*a*, 20*a*, 21*a*, 22*a* and fixed to the piston 18. Each pin hole 19*a*, 20*a*, 21*a*, 22*a* passes through the slider 19, 20, 21, 22 and has small and large diameter sections (not identified).

Each slider 19, 20, 21, 22 has a first end face 19*b*, 20*b*, 21*b*, 22*b* which is formed round and in slidable contact with the rounded side contact face 7*a*, 7*b*, 8*a*, 8*b* of the projection 7, 8. A second end face 19*c*, 20*c*, 21*c*, 22*c* of each slider 19, 20, 21, 22 faces and slidable contacts with the side contact face 16*a*, 16*b*, 17*a*, 17*b* of the extending section 16, 17 of the arm 11. The second end face 19*c*, 20*c*, 21*c*, 22*c* inclines relative to the above-mentioned plane P with the same inclination angle as that of the corresponding and contacting side contact face 16*a*, 16*b*, 17*a*, 17*b* of the extending section 16, 17. In other words, each second end face 19*c*, 20*c*, 21*c*, 22*c* is parallel with each side contact face 16*a*, 16*b*, 17*a*, 17*b* to maintain a tight slidable surface contact therebetween. Additionally, each of the two sliders 20, 22 having the second end face 20, 22 inwardly inclining in the direction toward the front cover 6 is provided with a coil spring 27A (27B) located in the large diameter section of the pin hole 20*a*, 22*a* in a manner to fit between the bottom of the pin hole large diameter section and the head of the pin 24, 26. Accordingly, each slider 20, 22 is always biased toward the piston 18 under the action of the coil spring 27A (27B) so that the second end face 20*c*, 22*c* of the slider 20, 22 and the side contact face 16*a*, 17*a* of the extending section 16, 17 are always maintained in a tight slidably contacting state.

A compression spring 50 having a relatively small biasing force is interposed between the rear end face of the piston 18 and the inner face of the front cover 6 is order to bias the piston 18 toward the camshaft 1. In this embodiment, the hydraulic oil pressure chamber 30 is defined between the front side surface of the flange section 10*a* of the sleeve 10 and the rear end face of the piston 18. The pressure chamber 30 is adapted to be supplied with oil pressure from the hydraulic oil pressure supply system 31 in order to cause the piston 18 to move forward or toward the front cover 6.

In this embodiment, the oil passage 35 includes an upstream part 35*a* formed vertically in the camshaft bearing 9 and communicating with the main gallery 34. An intermediate part 35*b* of the oil passage 35 communicates with the upstream part 35*a* and is formed generally cylindrical between the outer peripheral surface of the shaft section of the bolt 12 and the surfaces of the cylindrical bore 10*a* of the sleeve 10 and of the camshaft bearing 9. A downstream part 35*c* of the oil passage 35 communicates with the intermediate part 35*b* and is formed diametrically in the cylindrical section of the sleeve 10 to be communicated with the pressure chamber 30.

The pressure chamber 30 is in turn communicated with a pressure relief passage (not identified) through which oil pressure within the pressure chamber 30 can leak out of the the pressure chamber 30. The relief passage includes a plurality of inclined openings 51 formed obliquely in the inner cylindrical section 6*b* of the front cover 6 and communicating with the pressure chamber 30. The inclined openings 51 are in communication with a cylindrical passage 52 formed between the inner peripheral surface of the front cover inner cylindrical section 6*b* and the outer peripheral surface of the head section of the bolt 12. The cylindrical passage 52 is in communication with an annular passage 53 which is communicable with the outside of the driven sleeve 2 and the front cover 6 as discussed below.

The electromagnetic valve 40 in this embodiment includes a change-over valve 56 which is generally cylindrical and closed at its front end. The change-over valve 56 is movably disposed in a central hole (not identified) of a retainer 58 which is threadedly fitted in the inner cylindrical section 6*b* of the front cover 6. The retainer 58 is formed with a cylindrical passage forming member 54 having a rear end closed. The passage forming member 54 is formed with a plurality of through-holes 55 formed at the cylindrical section thereof. The inside of the cylindrical change-over valve 56 is communicable with the annular passage 53 through the through-holes 55. The passage forming member 54 has the same diameter as that of the central hole of the retainer. The change-over valve 56 is located coaxial with the bolt 12 and the camshaft 1 and axially slidably movable throughout the central hole of the retainer 58 and the inner bore of the passage forming member 54 which are contiguous with each other, so that the radial through-holes 55 are closable with the rear part wall of the change-over valve 56. The change-over valve 56 is formed at its front part with an oil discharge opening 59 formed through the cylindrical wall thereof in order to allow oil inside the change-over valve 56 to be discharged out. Additionally, a coil spring 60 is disposed in its compressed state between the change-over valve 56 and the bottom wall of the passage forming member 54 to bias the change-over valve 56 forward or in a direction to allow the radial through-holes 55 to open at the maximum degree. The forward movement of the change-over valve 56 is restricted by a stopper ring 61 fixed to the surface defining the central hole of the retainer 58, in which the front end of the large-diameter section of the outer wall of the change-over valve 56 strikes against the stopper ring 61.

The electromagnetic valve 40 further includes an electromagnetically operated actuator 57 which is known per se and includes a solenoid coil 62 and a core 63 which is integrally provided with an operating rod 64. Upon projection of the operating rod 64 toward the change-over valve 56, the change-over valve 56 is pushed in the direction of the camshaft 1 against the bias of the coil spring 60 so that the rear wall part of the change-over valve 56 closes the radial through-holes 55. In this embodiment, the main gallery 34 is provided with an orifice 65 for regulating the amount of hydraulic oil flowing therethrough, the orifice 65 being located downstream of the relief passage 37.

Figure 8:
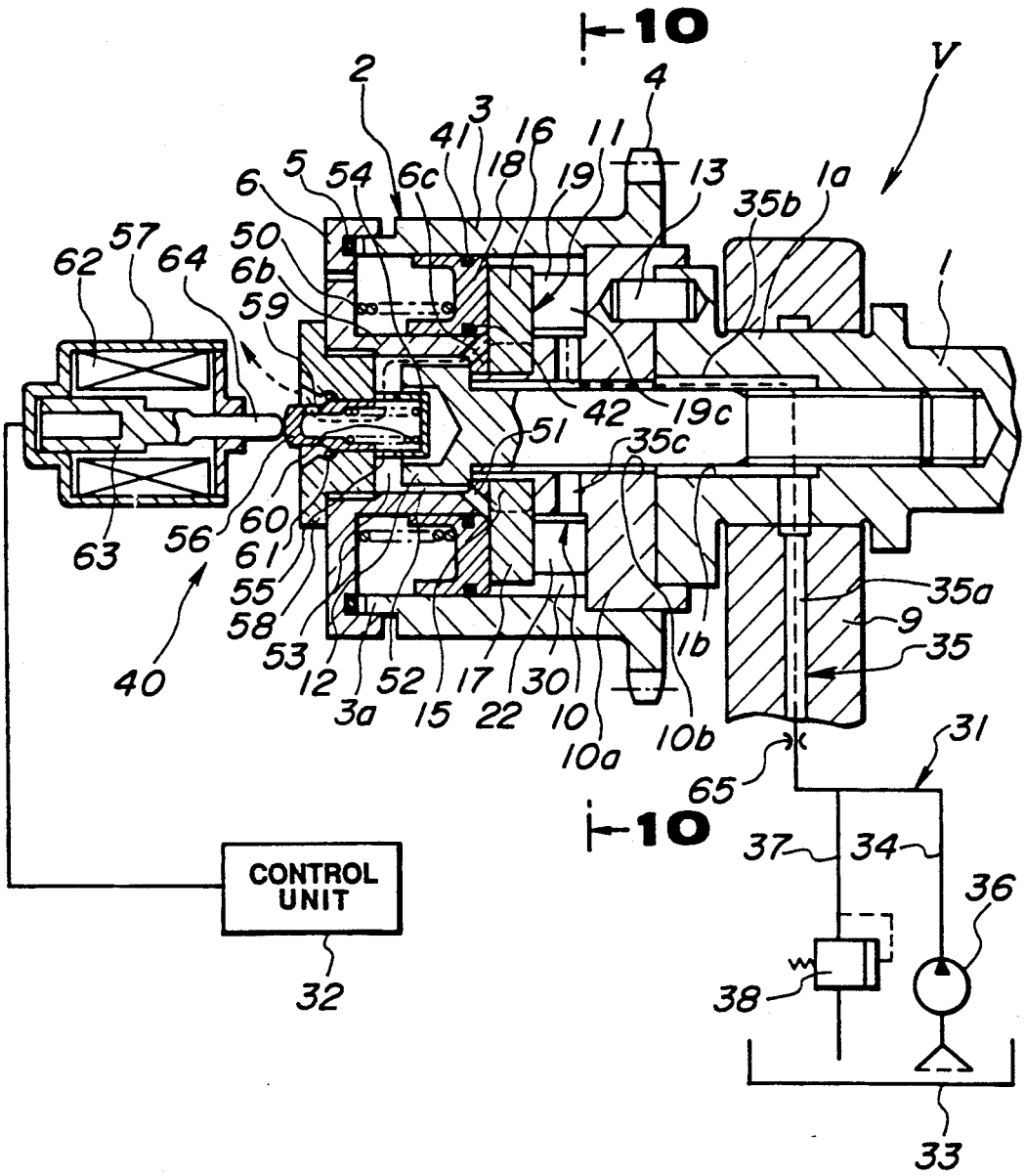
FIG. 8 is a vertical sectional view of a third embodiment of the valve timing control system in accordance with the present invention, showing an operational mode of the system.

The operation of the thus arranged third embodiment valve timing control system V is basically the same as that of the first and second embodiments and as follows:

Under the low engine speed and low engine load operating condition or under the high engine speed and high engine load operating condition, the control unit 32 outputs an OFF signal to the electromagnetic actuator 57 so that the solenoid coil 62 is deenergized. Accordingly, the change-over valve 56 is not pushed by the operating rod 64 of the electromagnetic actuator 57 and takes a forward position as shown in FIG. 8 under the bias of the coil spring 60. As a result, the radial through-holes 55 are opened and therefore oil pressure within the pressure chamber 30 is released to the outside or into a space defined by a rocker cover (not shown) through the inclined openings 51, the cylindrical passage 52, the annular passage 53, the radial through-holes 55 and the inside of the change-over valve 56 and finally the discharge opening 59 in the order mentioned. Consequently, the pressure chamber 30 is at a relatively low pressure, so that the piston 18 is pushed rearward or in rightward in FIGS. 8 and 9 under the bias of the compression spring 50. Accordingly, each slider 19, 20, 21, 22 moves rearward upon being slidingly guided along each side contact face 7*a*, 8*a*, 8*b*, 7*b* of the projection 7, 8, so that the second end faces 19*c*, 21*c* of the sliders 19, 21 respectively push the corresponding or contacting side contact faces 16*b*, 17*b* of the arm extending sections 16, 17 in a direction indicated by an arrow A in FIG. 11. Accordingly, the arm 11 is rotatingly moved in the reverse direction to the rotational direction R of the driven sprocket 2. This makes a relative rotational movement of the camshaft 1 in the direction reverse to the rotational direction R of the driven sprocket 2, i.e., in the direction of the arrow A in FIG. 10, thereby controlling the opening and closing timings of the intake valves to the retarded side.

Figure 12:
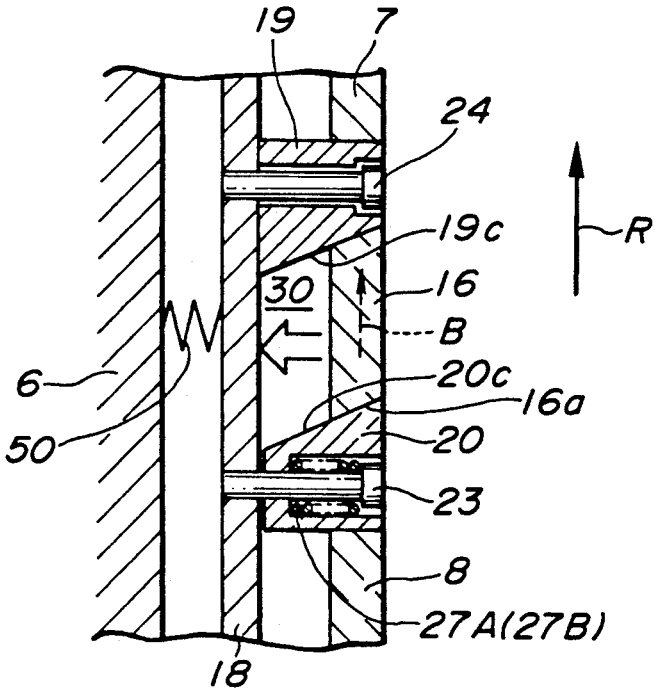
FIG. 12 is a sectional view similar to FIG. 11 but showing another operational mode of the sliding members.
Figure 9:
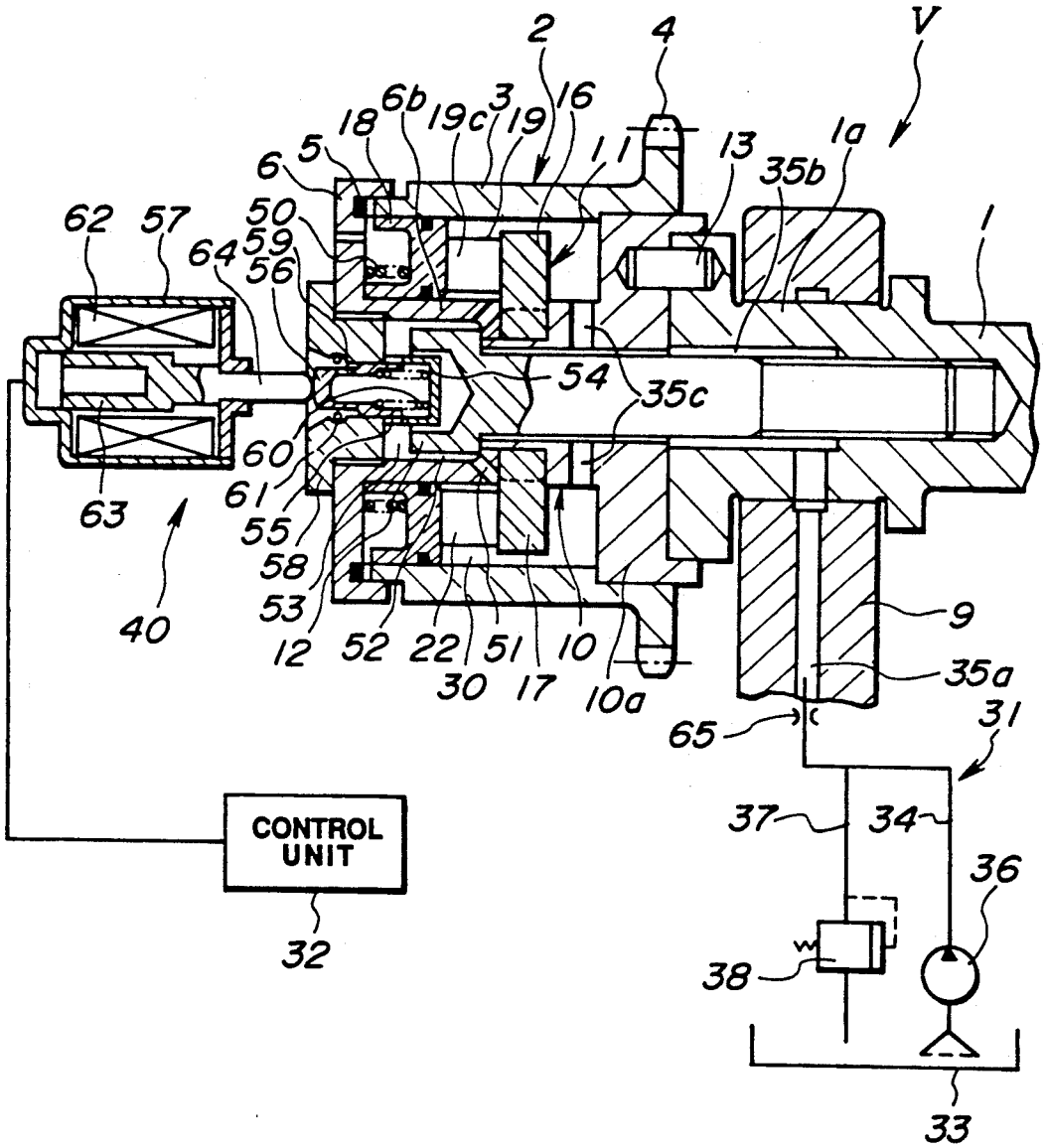
FIG. 9 is a vertical sectional view similar to FIG. 8 but showing another operational mode of the valve timing control system of FIG. 8.

Under the low engine speed and high engine load operating condition, an ON signal is output from the control circuit 32 to the electromagnetic actuator 57 so that the solenoid coil 62 is energized, so that the operating rod 64 pushes the change-over valve 56 rearward or rightward to take a rearward position shown in FIG. 9. Accordingly, the radial through-holes 55 are closed with the rear wall part of the change-over valve 56 as shown in FIG. 9. Then, oil pressure within the pressure chamber 30 pushes the piston 18 forward against the bias of the spring 50 so that the piston 18 takes a forward position shown in FIG. 9. Accordingly, the second end faces 20*c*, 22*c* of the sliders 20, 22 respectively push the corresponding or facing side contact faces 16*a*, 17*a* of the arm extending sections 16, 17 in the direction of the arrow B as shown in FIG. 12, upon the sliding movement of each side contact face 16*a*, 17*a* of the arm extending sections 16, 17 along the inclinded second end face 20*c*, 22*c* of the slider 20, 22. As shown in FIG. 12, at the front-most position of the piston 18, each slider 19, 20, 21, 22 reaches a position at which the front surface of the arm 11 is brought into flush with the front face of each slider 19, 20, 21, 22. Thus, the arm 11 is rotatingly moved in the same direction as the rotational direction R of the driven sprocket 2. Hence, the camshaft 1 makes its relative rotation to the driven sprocket 2 in the direction of the arrow B, therby controlling the opening and closing timings of the intake valves to an advanced side.

It will be understood that, in this embodiment, the change-over valve 56 and the electromagnetic actuator 57 constituting the electromagnetic valve 40 are disposed on the side of the driven sprocket 2, and therefore freedom in layout of the valve timing control system V is enlarged as compared with a case the electromagnetic valve 40 is disposed on the side of the main gallery 34, so that the system of this embodiment can be used in an automotive vehicle having a relatively small engine compartment. Additionally, encasing the change-over valve 56 in the driven sprocket 2 makes the valve timing control system V small-sized, thus further enlarging freedom in layout of the system.

While the valve timing control systems V of the embodiments have been shown and described as being applied to controlling the intake valves, it will be understood that the principle of the present invention may be applicable to controlling exhaust valves or both the intake and exhaust valves.

What is claimed is:

1. A valve timing control system of an internal combustion engine, comprising:

a generally cylindrical rotatable member coaxially and movably connected to one end of a camshaft, said rotatable member being drivably connected to a camshaft of the engine;

an arm fixed to the one end of the camshaft and projecting radially outwardly;

a generally annular piston located coaxial with the camshaft and movably disposed inside said cylindrical rotatable member, said piston being movable in an axial direction of the camshaft;

at least three sliding members supported on said piston and slidably movable inside said rotatable member, each sliding member having an inclined face which is inclined relative to a plane parallel with the axis of the camshaft so as to push said arm in a direction to rotate around the axis of the camshaft; and means for driving said piston in the axial direction of the camshaft in accordance with an engine operating condition.

2. A valve timing control system as claimed in claim 1, wherein said at least three sliding members are supported generally on a same plane perpendicular to the axis of the camshaft, said sliding members being located at generally equal intervals in a peripheral direction of said piston.

3. A valve timing control system as claimed in claim 1, wherein at least three sliding members extend in the axial direction of the camshaft and includes at least one first sliding members having a first inclined face by which a sectional area of said sliding member increases in a direction toward said piston, and at least one second sliding member having a second inclined surface by which a sectional area of said sliding member decreases in the direction toward said piston.

4. A valve timing control system as claimed in claim 1, wherein said driving means includes means for controlling a pressure to be applied to said cylinder in accordance with said engine operating condition.

5. A valve timing control system as claimed in claim 4, wherein said piston has an annular face perpendicular to the axis of the camshaft, said annular face defining a pressure chamber to which said pressure is supplied.

6. A valve timing control system as claimed in claim 5, wherein said at least three sliding members are first, second, third and fourth sliding members, said first amd second sliding members being opposite to each other with respect to the axis of the camshaft, said third and fourth sliding members being opposite to each other with respect to the axis of the camshaft.

7. A valve timing control system as claimed in claim 1, further comprising a generally cylindrical support member coaxially and fixedly secured to the one end of the camshaft, said support member including a radially outwardly extending flange section on which said rotatable member is movably mounted, said arm being fixed to said support member.

8. A valve timing control system as claimed in claim 7, wherein said piston is slidably disposed betweem an outer peripheral surface of said support member and an inner peripheral surface of said rotatable member.

9. A valve timing control system as claimed in claim 1, wherein said driving means includes a compression spring disposed to bias said piston toward said arm.

10. A valve timing control system as claimed in claim 1, wherein said arm has a side face contactable with said inclined face of said sliding member, said side face has an inclination same as that of said inclined face of said sliding member, relative to said plane.

11. A valve timing control system as claimed in claim 6, wherein said arm has first and second extending sections which are located opposite to each other with respect to the axis of the crankshaft and radially outwardly extend, said first extending section having first and second side faces which are respectively contactable with the inclined faces of said first and second sliding members, said second extending section having third and fourth side faces which are rspectively contactable with the inclined surfaces of said third and fourth sliding members, said first and third side faces being located generally opposite with respect to the axis of the camshaft, said second and fourth side faces being located generally opposite with respect to the axis of the camshaft.

12. A valve timing control system as claimed in claim 5, said pressure controlling means including a pressure control valve operatively connected to said pressure chamber, said pressure control valve controlling the pressure within said pressure chamber in accordance with said engine operating condition.

13. A valve timing control system as claimed in claim 12, wherein said pressure controlling means includes means defining a pressure supply passage through which said pressure is supplied to said pressure chamber.

14. A valve timing control system as claimed in claim 13, wherein said pressure control valve is operatively connected to said pressure supply passage.

15. A valve timing control system as claimed in claim 13, wherein said pressure controlling means includes means defining a pressure relief passage through which the pressure within said pressure chamber is released.

16. A valve timing control system as claimed in claim 15, wherein said pressure control valve is operatively connected to said pressure relief passage.

17. A valve timing control system as claimed in claim 1, wherein driving means is arranged to driving said piston in accordance with at least engine speed and loads.

* * * * *